United States Patent [19]

Fagg et al.

[11] Patent Number: 5,025,812

[45] Date of Patent: Jun. 25, 1991

[54] TOBACCO PROCESSING

[75] Inventors: Barry S. Fagg; Gary M. Dull, both of Winston-Salem; Richard G. Haberkern, King; Robert A. Merricks; John E. Stewart, both of Winston-Salem, all of N.C.

[73] Assignee: R. J. Reynolds Tobacco Company, Winston-Salem, N.C.

[21] Appl. No.: 392,519

[22] Filed: Aug. 10, 1989

[51] Int. Cl.[5] ..... A24B 15/24; A24B 15/26

[52] U.S. Cl. ..... 131/297; 131/298; 131/352; 131/356; 131/310

[58] Field of Search ..... 131/297, 298, 310, 352, 131/356

[56] References Cited

U.S. PATENT DOCUMENTS

| | | |
|---|---|---|
| 678,362 | 7/1901 | Froehling . |
| 802,487 | 10/1905 | Wimmer . |
| 1,196,184 | 8/1916 | Villiers-Stuart . |
| 1,294,310 | 2/1919 | Sayre et al. . |
| 1,949,012 | 2/1934 | Frank . |
| 2,128,043 | 8/1938 | Garner . |
| 2,227,863 | 1/1941 | Rhodes . |
| 2,582,075 | 1/1952 | Severi . |
| 2,805,667 | 9/1957 | Von Bethmann . |
| 2,822,306 | 2/1958 | Thienemann et al. . |
| 3,046,997 | 7/1962 | Hind . |
| 3,096,773 | 7/1963 | Neukomm et al. . |
| 3,139,435 | 6/1964 | Staley et al. . |
| 3,390,685 | 7/1968 | Von Bethmann et al. . |
| 3,396,735 | 8/1968 | Von Bethmann et al. . |
| 3,561,451 | 2/1971 | Jacin et al. . |
| 4,068,671 | 1/1978 | Casey . |
| 4,153,063 | 5/1979 | Roselius et al. . |
| 4,744,375 | 5/1988 | Denier et al. . |

FOREIGN PATENT DOCUMENTS

| | | |
|---|---|---|
| 280817 | 9/1988 | European Pat. Off. . |
| 323699 | 7/1989 | European Pat. Off. . |

*Primary Examiner*—V. Millin

[57] ABSTRACT

Denicotinized tobacco cut filler is provided by (i) extracting the cut filler with an aqueous denicotinized extract and thereby providing a mixture of aqueous extract and extracted cut filler, (ii) deliquoring the mixture of aqueous extract and extracted cut filler such that a certain level of tobacco extract remains in contact with the extracted cut filler, and (iii) drying the deliquored tobacco extract/extracted cut filler to provide a processed cut filler. Greater than 90 percent of the nicotine present in tobacco cut filler can be removed therefrom using such process steps.

39 Claims, 3 Drawing Sheets

TOBACCO PROCESSING

BACKGROUND OF THE INVENTION

The present invention relates to tobacco, and in particular to a process for changing the chemical nature of tobacco.

Popular smoking articles such as cigarettes have a substantially cylindrical rod shaped structure and include a charge of smokable material such as shreds or strands of tobacco material (i.e., in cut filler form) surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. Oftentimes, tobacco is chemically or physically treated to modify flavor and smoking characteristics thereof. In certain circumstances, it may be desirable to selectively remove components, such as nicotine, from tobacco. Various processes directed toward removing nicotine from tobacco have been proposed. Many of such types of processes are discussed in European Patent Application No. 280817 and U.S. Pat. No. 4,744,375 to Denier et al. Another process for removing nicotine from tobacco is described in European Patent Application No. 323 699.

It would be desirable to provide a process for efficiently and effectively altering the chemical nature or composition of tobacco, and in particular to provide a process for removing selected components from a tobacco material.

SUMMARY OF THE INVENTION

The present invention relates to a process for altering the chemical composition of a tobacco material. In a highly preferred embodiment, the process involves removing at least one selected substance from a tobacco material. The process involves extracting tobacco material with an extraction solvent thereby providing a tobacco extract within the extraction solvent. The chemical composition of the tobacco extract is altered so as to provide a processed tobacco extract. In a highly preferred embodiment, the processed tobacco extract is provided by removing at least one selected substance from the extract. The processed tobacco extract is provided within extraction solvent, and contacted with a further amount (i.e., a second lot) of tobacco material under extraction conditions. As such, there is provided a mixture of (i) solvent, (ii) tobacco extract, and (iii) tobacco material insoluble in the solvent. The tobacco material insoluble in the solvent is separated from a portion of the tobacco extract and solvent, and that portion of tobacco extract and solvent is collected. Then, at least a portion of the solvent is separated from the resulting mixture of solvent, extract and tobacco material insoluble in the solvent to provide a processed tobacco material. The tobacco extract and solvent portion, which previously had been collected, can be processed further to alter the chemical composition of the tobacco extract, thus providing a further processed extract. Such a resulting processed tobacco extract is provided within extraction solvent and is employed to extract yet a further amount (i.e., a third lot) of tobacco material under extraction conditions. As such, the process steps can continue in order to alter the chemical composition of an indefinite amount (i.e., an indefinite number of lots) of tobacco material.

The present invention relates particularly to a process for removing amounts of alkaloids, such as nicotine, from tobacco material. Such a process involves providing a tobacco extract within an extraction solvent having an aqueous character (e.g., water) by extracting a tobacco material with the solvent. Nicotine is removed from the extract to provide a denicotinized tobacco extract. The denicotinized tobacco extract is provided within extraction solvent and contacted with a further amount (i.e., a second lot) of tobacco material under extraction conditions. As such, there is provided a slurry of an aqueous tobacco extract and a water insoluble tobacco material. The water insoluble tobacco material is separated from a predetermined portion of the solvent and tobacco extract (i.e., the slurry is "deliquored" to remove a certain amount of aqueous tobacco extract from the insoluble portion while providing a moist mixture of insoluble tobacco material and tobacco extract). Then, at least a portion of the extraction solvent is separated from the deliquored portion (i.e., the moist mixture of water insoluble tobacco material and tobacco extract is dried to a desired moisture level). Normally, the level of tobacco extract within extraction solvent is such that, when the water insoluble tobacco portion of the second lot of tobacco material is deliquored, an amount of tobacco extract remains in contact with the insoluble tobacco material so that, when dried to the desired moisture level, the resulting mixture of tobacco extract and insoluble tobacco material has a dry weight essentially equal to that of the tobacco material prior to the time that such tobacco material was subjected to extraction conditions but adjusted for the weight of the substance(s) removed from the tobacco material during the process steps of the present invention.

In a highly preferred embodiment of the present invention, the tobacco extract has selected substance(s) removed therefrom by contacting liquid extraction solvent containing the tobacco extract (i.e., an extract/extraction solvent mixture) with a second liquid solvent. The second solvent is immiscible with the extract/extraction solvent mixture, and selected substance(s) within the extract/extraction solvent mixture are transferred to within the second solvent. The processed tobacco extract/extraction solvent mixture then is separated from the second solvent that includes the selected substance(s) removed from the tobacco extract.

In a preferred process for denicotinizing tobacco, an aqueous liquid extraction solvent containing an aqueously extracted tobacco extract (i.e., an aqueous tobacco extract) is adjusted to a pH of greater than about 9, and contacted with a second liquid solvent which is (i) immiscible with the aqueous tobacco extract, and (ii) a good solvent for nicotine. After contact has occurred for the desired period under the desired conditions, the aqueous tobacco extract and the second solvent are separated from one another. As such, there is provided an aqueous tobacco extract which is a denicotinized aqueous tobacco extract, and the second solvent containing nicotine.

The process of the present invention provides the skilled artisan with an efficient and effective method for altering the chemical nature or composition of a tobacco material in a controlled manner. That is, the process of the present invention can be employed in a way such that changes in the chemical composition of tobacco can be monitored so as to occur to a desired degree. Of particular interest is a process for removing selected substance(s) from tobacco. In particular, significant quantities of selected substance(s), such as nicotine, can be removed from a tobacco material while the removal of other substances from that tobacco material is minimized. A preferred process according to the present invention involves denicotinizing tobacco material (e.g., in cut filler or strip form) such that greater than about 90 percent, preferably greater than about 95 percent of the nicotine present within the starting tobacco material is removed therefrom.

DETAILED DESCRIPTION OF THE PREFERRED EMBODIMENTS

Figure 1:
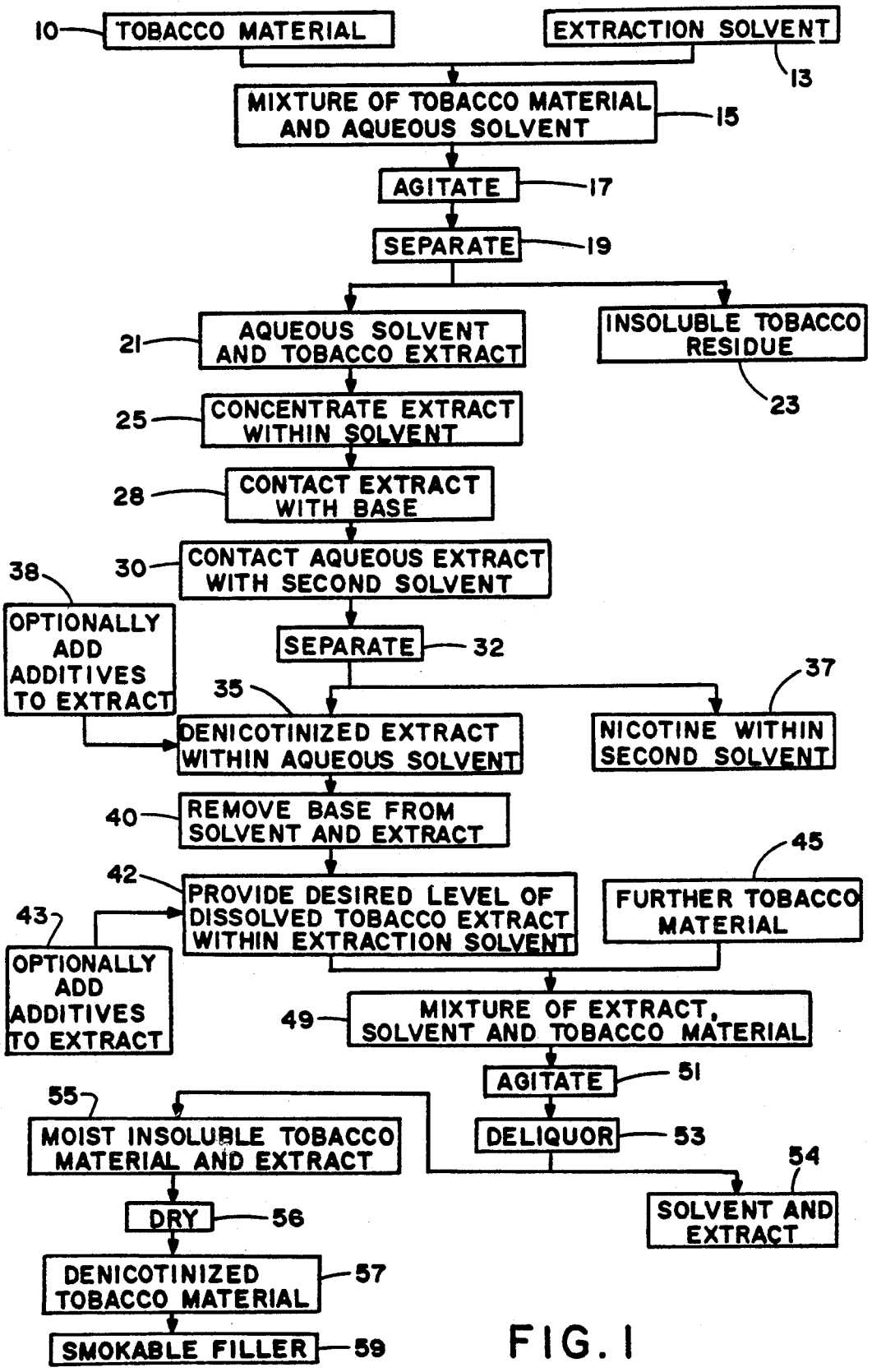
FIG. 1 is a schematic diagram of the process steps representative of one embodiment of the present invention.

Referring to FIG. 1, tobacco material 10, such as tobacco dust, cut filler or strip, is contacted with an aqueous extraction solvent 13. Contact can be performed in either a continuous or batch-wise manner. The mixture 15 of tobacco material 10 and extraction solvent 13 can be agitated 17 in order to enhance removal of water soluble components from the tobacco material. The mixture is subjected to separation conditions 19 so as to provide an aqueous tobacco extract 21 (i.e., a water soluble tobacco extract within the extraction solvent), and a water insoluble tobacco residue 23. Optionally, the aqueous tobacco extract 21 is concentrated 25 to an appropriate dissolved tobacco solids level using a thin film evaporator, or the like.

Although the pH of the aqueous tobacco extract 21 depends upon factors such as the particular tobacco material 10 which is extracted, the aqueous tobacco extract normally exhibits a pH below about 6. The aqueous tobacco extract is contacted with ammonia 28 (e.g., as ammonium hydroxide or gaseous ammonia) to increase the pH of the aqueous tobacco extract to about 9 or above, most preferably to about 10 or above. The aqueous tobacco extract having an increased pH due to the added ammonia 28 is contacted with a second solvent 30, such as monofluorotrichloromethane (i.e., a good solvent for nicotine), such that nicotine is transferred from the aqueous tobacco extract to within the second solvent. The two solvents and extracted substances therein then are separated 32 from one another. As such, there is provided (i) a denicotinized aqueous tobacco extract 35, and (ii) a nicotine-containing second solvent 37. Optionally, selected additives 38 can be incorporated into the denicotinized extract 35 to further alter the chemical composition of the extract.

The denicotinized aqueous tobacco extract 35 is processed further 40 to remove a substantial portion of the ammonia therefrom. For example, the aqueous extract 35 is spray dried (i.e., to evaporate aqueous solvent and ammonia, and provide a powdered spray dried extract); or distilled (i.e., under conditions to evaporate ammonia); and, as such, remove essentially all or a significant portion of the added ammonia from the extract.

The denicotinized tobacco extract which is processed so as to have added ammonia removed therefrom is contacted with sufficient aqueous extraction solvent so as to provide a denicotinized aqueous tobacco extract 42. A particularly preferred amount of processed denicotinized extract within an aqueous extraction solvent is an amount which ranges from about 10 to about 30 weight percent extract (e.g., dissolved tobacco solids), based on the total weight of the tobacco extract and solvent. Optionally, selected additives 43 can be incorporated into the denicotinized aqueous tobacco extract to further alter the chemical composition of the extract.

A further amount (i.e., a new lot) of tobacco material 45, such as tobacco cut filler or strip, is contacted with the processed denicotinized aqueous extract 42 so as to provide a mixture 49 (e.g., slurry) of tobacco extract, solvent and tobacco material insoluble in the solvent. Contact can be provided in either a continuous or batch-wise manner, as discussed in detail hereinafter. The tobacco extract of the resulting mixture 49 includes components of the denicotinized tobacco extract and components extracted from the tobacco material 45. The mixture 49 of tobacco material, extract and extraction solvent can be agitated 51 in order to to enhance extraction of water soluble components from the tobacco material, while preferably minimizing degradation of the water insoluble tobacco material.

Contact of the mixture 49 of extract, tobacco material and solvent is effected until the nicotine content of the mixture is relatively low. For example, in a batch process, (i) the amount of extract and solvent is sufficiently great relative to the tobacco material such that the nicotine content of the mixture is low, based on the total weight of the mixture, or (ii) the tobacco material is extracted batch-wise successively for a sufficient number of times such that the mixture has a low nicotine content, based on the total weight of the mixture. Alternatively, in a continuous process, (i) the denicotinized extract and solvent are continuously contacted with the tobacco material until the mixture has a very low nicotine content, or (ii) the denicotinized extract and solvent are continuously contacted with a continuous supply of tobacco material so as to provide a mixture having a very low nicotine content.

After contact of the mixture 49 of tobacco material, extract and solvent is complete, the slurry is deliquored 53. For example, the insoluble tobacco material is squeezed or pressed to remove a certain portion 54 of the extract and solvent (i.e., aqueous extract) therefrom. The resulting moist mixture of extract and water insoluble tobacco material 55 is such that the dry weight thereof is essentially equal to that of the tobacco material 45 prior to processing steps of the present invention minus the nicotine and other tobacco components which are removed therefrom plus any additives which are added thereto.

The deliquored tobacco material is subjected to a drying operation 56 so as to yield a denicotinized tobacco material 57 having a moisture content of about 10 to about 15 weight percent. Preferably, the denicotinized tobacco material 57 exhibits an ammonia content of less than about 1 weight percent, more preferably less than about 0.5 weight percent. The resulting denicotinized tobacco material 57 is used as smokable material 59 for the manufacture of cigarettes. For example, the denicotinized tobacco material can be cased, top dressed, further processed or treated, screened to provide material of the desired size, and/or blended with other smokable materials.

Figure 2:
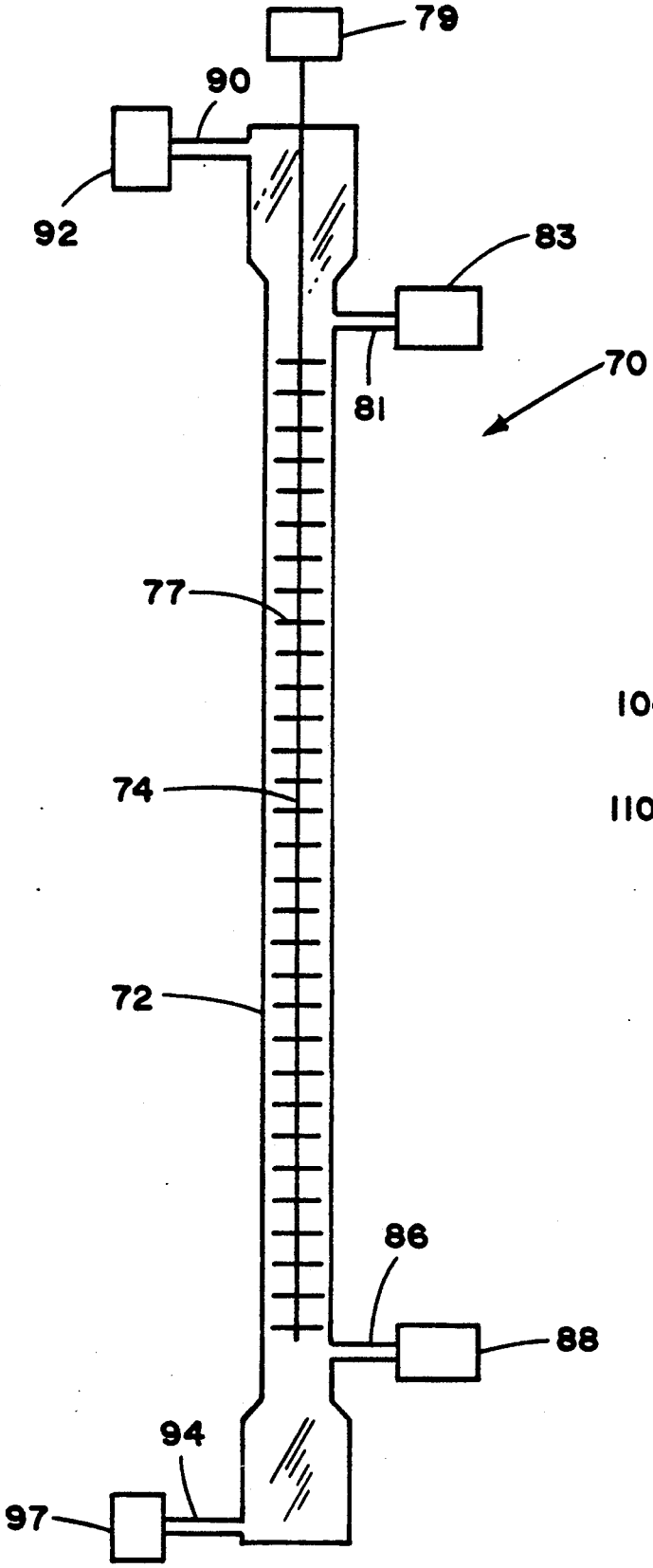
FIG. 2 is a schematic diagram of a representative apparatus for performing certain of the process steps of the present invention.

Referring to FIG. 2, there is shown an apparatus 70 for performing certain preferred process steps of the present invention. Such an apparatus is known to the skilled artisan as a Karr Reciprocating Plate Extraction Column. See, Karr, *A. I. Ch. E. Journ.*, Vol. 5, p. 446 (1959). The apparatus 70 includes a long, slender tube or column 72 which is positioned such that the longitudinal axis thereof is in an essentially vertical plane. Essentially coaxially with the longitudinal axis of the column is inserted a shaft 74 which supports a plurality of extraction plates 77 spaced at intervals along the shaft. The plates 77 preferably are positioned perpendicularly to the shaft 74. The shaft is supported by a variable speed drive agitator 79 or other such means which moves the shaft (and hence the series of plates) periodically up and down. The column 72 includes an upper input region or nozzle 81 into which the second (e.g., heavy) liquid solvent is fed continuously from source 83. The column also includes lower input region 86 or nozzle into which the liquid aqueous tobacco extract is fed continuously from source 88.

The shaft 74 (and hence the plates 77) is reciprocated at a rate sufficient to provide adequate contact of the two liquids but at a sufficiently low rate so as to minimize or eliminate undesirable emulsion formation between the two liquids. The raffinate (i.e., the denicotinized aqueous tobacco extract which has been contacted with the second solvent) exits the column 72 at output region 90 and is collected in reservoir 92. The second solvent and selected substance(s) transferred from the extraction solvent exit the column at output region 94, and are collected in reservoir 97.

Figure 3:
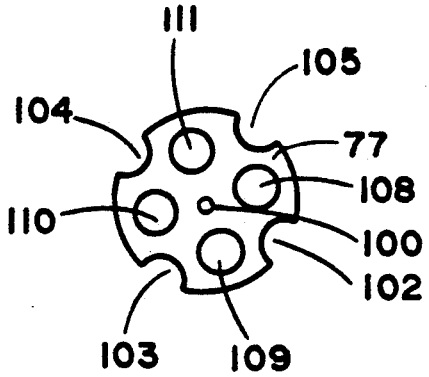
FIG. 3 is an enlarged view of a component of the apparatus shown in FIG. 2.

Referring to FIG. 3, there is shown an end view of a representative extraction plate 77 taken along the longitudinal axis of the column shown in FIG. 2. The spacer 77 has a diameter which approximates the inner diameter of the column. The plate has an opening 100, through which the shaft extends. The plate also includes a series of peripheral openings 102, 103, 104 and 105 as well as inner openings 108, 109, 110 and 111, such that the liquids can pass therethrough. Normally, the plate is manufactured from a metal such as stainless steel, a polymeric material such as Teflon, or the like.

Figure 4:
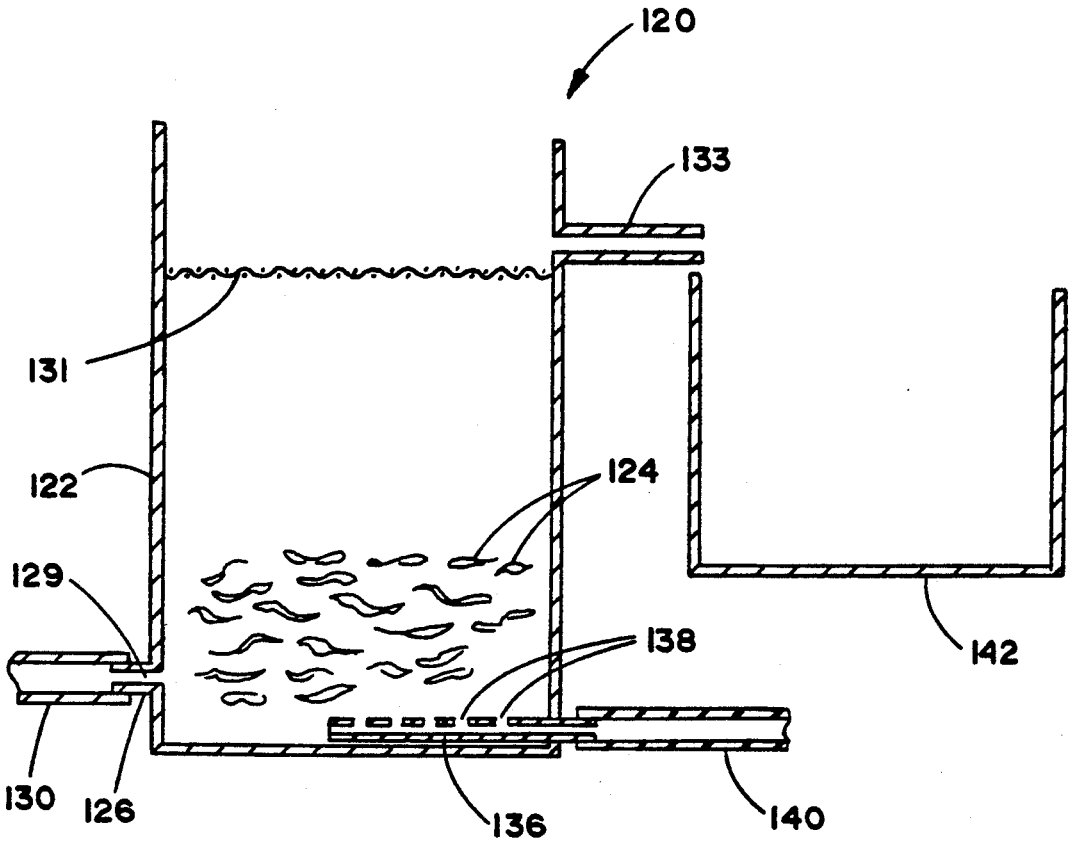
FIG. 4 is a cross-sectional view of a representative apparatus for performing certain process steps of the present invention.

Referring to FIG. 4, there is shown an apparatus 120 for performing certain process steps of the present invention. Container 122 has side walls and a bottom wall, and contains tobacco material 124 to be extracted. Into bottom feed port 126 is fed a denicotinized aqueous tobacco extract 129 which, in turn, contacts the tobacco material 124. The denicotinized aqueous tobacco extract is fed from a reservoir (not shown) through tube 130 (shown as cut away) using a suitable pump (not shown). Screen 131 is positioned over the tobacco material but below exit port 133 in order to prevent insoluble tobacco material from exiting the container. A tube or plenium 136 having a plurality of perforations 138 therein is connected to air line 140 (shown as cut away) from an air source (not shown) to provide agitation by a bubbling action to the aqueous extract. As such, the tobacco material 124 is subjected to extraction conditions in the presence of a denicotinized aqueous tobacco extract 129. Aqueous tobacco extract which exits the exit port 133 is collected in reservoir 142 (not shown to scale), is later processed to remove nicotine therefrom, and can be used for extracting a further portion of lot of tobacco material. If desired, several apparatus 120 can be provided in series so that aqueous tobacco extract exiting one container containing tobacco material can be contacted with tobacco material in another container.

The apparatus 120 provides a convenient means for continuously contacting a supply of a denicotinized aqueous tobacco extract with a sample of tobacco material. In particular, denicotinized aqueous tobacco extract can be continuously passed through container 122 containing tobacco material 124 at a desired rate until the mixture of aqueous tobacco extract and tobacco material exhibits a desirably low nicotine content. Alternatively, the apparatus 120 can be employed to provide a batch-wise contact of a denicotinized aqueous tobacco extract with a sample of tobacco material. In particular, aqueous tobacco extract can be recirculated through the container 122 containing tobacco material 124.

The tobacco material which is altered chemically according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. Examples of types of suitable tobacco materials include flue-cured, Burley, Md., and Oriental tobaccos, as well as the rare or specialty tobaccos. Normally, the tobacco material has been aged. The tobacco material can be in the form of laminae and/or stem, or can be in a processed form. For example, the tobacco material can be in the form of whole leaf, strip, cut filler, processed stem, volume expanded tobacco filler, reconstituted strip or filler, or tobacco previously extracted to a certain degree. Tobacco waste materials and processing by-products (e.g., scrap and dust) also can be employed. The aforementioned tobacco materials can be processed separately, or as blends thereof.

The tobacco material can have a variety of sizes for extraction. The tobacco material most preferably is in strip form or cut filler form. Tobacco materials in strip or cut filler form are desirable in that the ultimately processed tobacco materials are employed as such for the manufacture of cigarettes.

The tobacco material is contacted with an extraction solvent. A highly preferred extraction solvent is a solvent having an aqueous character. Such a solvent consists primarily of water, is normally greater than 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. An example of such a co-solvent mixture is a solvent consisting of 95 parts water and 5 parts ethanol. The extraction solvent also can include water having substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more.

The amount of tobacco material which is contacted with the extraction solvent can vary. Typically, for a batch-wise extraction, the weight of extraction solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco material which is extracted, the manner in which contact of the tobacco material and solvent is conducted, the type of extraction process which is performed, and other such factors. The manner for contacting the tobacco material with the extraction solvent is not particularly critical, and as such, the tobacco material can be extracted in either a continuous or batch-wise manner.

The conditions under which the extraction is performed can vary. Typical temperatures range from about 5° C. to about 75° C., with about 10° C. to about 60° C. being preferred, about 15° C. to about 35° C. being more preferred, and ambient temperature being particularly preferred. The solvent/tobacco material mixture can be agitated (e.g., stirred, shaken or otherwise mixed) in order to increase the rate at which extraction occurs. Typically, for a batch-wise extraction, adequate extraction of components occurs in less than about 60 minutes, oftentimes in less than about 30 minutes.

A wide variety of components can be extracted from the tobacco materials. The particular components and the amounts of the particular components which are extracted often depend upon the type of tobacco which is processed, the properties of the particular solvent, and the extraction conditions (e.g., which include the temperature at which the extraction occurs as well as the time period over which an extraction is carried out). For example, an extraction solvent consisting essentially of pure water will most often extract primarily the water soluble components of the tobacco material, while a co-solvent mixture of water and a minor amount of an alcohol can extract the water soluble components of the tobacco material as well as certain amounts of tobacco substances having other solubility characteristics. Water soluble tobacco components which are extracted from a tobacco material using a solvent having an aqueous character include alkaloids, acids, salts, sugars, and the like. Water soluble extracted tobacco components include many of the flavorful substances of the tobacco material.

The extraction solvent and tobacco extract then are separated from the insoluble tobacco residue. The manner of separation can vary; however, it is convenient to employ conventional separation techniques such as filtration, centrifugation, or the like. It is desirable to provide a solution of solvent and extract having a very low level of suspended solids. Preferably, the insoluble residue is treated so as to remove a predetermined amount of solvent and tobacco extract therefrom. The insoluble residue is not necessarily used in further stages of the process, and may be discarded.

The solvent and tobacco components extracted thereby can be filtered to remove suspended insoluble particles; concentrated; diluted with solvent; or spray dried, freeze dried, or otherwise processed, particularly for storage or handling reasons. Dried extracts, such as spray dried tobacco extracts, can be later redissolved in extraction solvent for later treatment and further extraction process steps.

The chemical composition of the tobacco extract is altered so as to provide a processed extract, and a variety of techniques can be employed to alter the chemical composition of the tobacco extract. For example, the tobacco extract can be heat treated; processed to remove nicotine, nitrates or other such components therefrom; subjected to membrane treatment to remove certain soluble or dispersible high molecular weight components; or contacted with at least one additive including casing materials, top dressing materials, organic acids (e.g., citric, ascorbic, malic, tartaric, lactic, acetic, succinic or malonic acids), monoammonium phosphate, diammonium phosphate, ammonia, sugars, amino acids, hydrolyzed amino acids, or combinations thereof. The types and amounts of additives which are incorporated into a particular tobacco extract can vary depending upon the desired nature of the ultimate tobacco material which is chemically altered, and the types and amounts of additives employed can be determined by experimentation. If desired, certain components can be removed from the tobacco extract and certain selected additives can be incorporated into the tobacco extract. If desired, a tobacco extract within extraction solvent can be subjected to ion exchange, adsorption or further extraction treatments. In a preferred aspect, an aqueous tobacco extract is subjected (i) to liquid/liquid extraction processing steps, or (ii) to supercritical extraction processing steps, as described in U.S. Pat. application Ser. No. 07/310,413, filed Feb. 13, 1989, which is incorporated herein by reference. Methods for removing nitrates from tobacco extracts (e.g., for removing potassium nitrate from a Burley extract) will be apparent to the skilled artisan. See, U.S. Pat. No. 4,131,117 to Kite et al.

For an aqueous tobacco extract, the pH thereof can be altered. The pH of the aqueous tobacco extract can be raised to promote removal of basic compounds therefrom, lowered to promote removal of acidic compounds therefrom, or made neutral to promote removal of neutral compounds therefrom. For example, the pH of the aqueous tobacco extract can be raised so as to enhance the removal of alkaloids, such as nicotine, therefrom upon contact with a second solvent which is a good solvent for the alkaloids. Typically, for certain processes, the pH of the aqueous tobacco extract is altered so as to be about 7 or more, frequently about 8 or more, and occasionally about 9 or more. For maximum removal of nicotine, the pH of the aqueous tobacco extract is altered so as to be about 10 or more. Preferred basic materials for raising the pH of the aqueous tobacco extract include gaseous ammonia and ammonium hydroxide. Other agents for altering the pH of the extraction solvent and tobacco extract will be apparent to the skilled artisan. It may be desirable to alter the pH of aqueous tobacco extract, perform a liquid/liquid extraction step to remove certain substance(s) from the aqueous extract, collect the resulting aqueous extract, alter the pH of that resulting aqueous extract, and perform a second processing step to remove certain other substance(s) from that aqueous extract. The amount of tobacco extract relative to the amount of extraction solvent during the liquid/liquid extraction step with the second solvent can vary. Although highly concentrated extracts can be employed, the dissolved tobacco components typically present within extraction solvent are less than about 25 weight percent, normally less than about 20 weight percent.

The second solvent can vary. The second solvent can have a gaseous or liquid form. Thus, selected substance(s) can be removed from a tobacco extract within a liquid extraction solvent using either gas/liquid or liquid/liquid separation techniques. An example of a gaseous solvent is an inorganic solvent, such as sulfur hexafluoride. Preferred solvents are employed in a liquid form. Preferably, the second solvent is a halocarbon such as monofluorotrichloromethane (CFC 11) or halogenated hydrocarbon such as dichlorotrifluoroethane (HCFC 123). Other second solvents include the triglycerides. Triglyceride compounds include palm oil, linseed oil, soybean oil, corn oil, and the like. Organic solvents such as pentane, hexane, heptane, n-propyl acetate, ethyl acetate and i-propyl acetate also can be employed. Preferred second solvents are very good solvents for certain selected substances within the tobacco extract, and are immiscible with the extraction solvent. When the Karr Reciprocating Plate Extraction Column is employed, it is particularly desirable that the tobacco extract/extraction solvent mixture and second liquid solvent have densities which are substantially different from one another.

The extract/extraction solvent mixture and second solvent normally are immiscible with one another in the highly preferred aspects of the present invention. By this is meant that the extract/extraction solvent mixture and the second solvent do not have a propensity to mix with one another, and remain in distinct phases upon contact. Preferably, when contacted with one another under conditions at which the liquid/liquid extraction steps are performed, the extract/extraction solvent mixture and second solvent do not emulsify to any significant degree. For many immiscible solvents useful according to this invention, the solubility of the second solvent in the extract/extraction solvent mixture preferably is less than about 1 weight percent, and more preferably less than about 0.5 weight percent, at 20° C.

The extract/extraction solvent mixture is contacted with the second solvent to provide a two phase mixture of liquids. Normally, the temperatures of the two phases are controlled so that both the extract/extraction solvent mixture and second solvent remain below their respective boiling points during the period of contact of the phases. When the second solvent is CFC 11 or HCFC 123, it is desirable to maintain both of the liquids at a temperature below about 20° C. at atmospheric pressure during the time that the two liquids are in contact. Typically, the temperature at which the liquid/liquid extraction is performed is high enough to minimize or eliminate the formation of an emulsion but low enough to minimize or eliminate the vaporization of either or both of the liquids. However, the temperature of the two liquids can be selected so as to provide an optimum transfer of selected substances from within the extraction solvent to within the second solvent.

The two liquids are subjected to conditions sufficient to transfer selected tobacco substance(s) from within the extraction solvent to within the second solvent. For example, certain extracted tobacco components within the extraction solvent may have a preferential solubility in the second solvent. In particular, for an aqueous tobacco extract having a pH of about 10 or more, nicotine and other alkaloids present within the aqueous tobacco extract are preferentially soluble in a second solvent, such as a halocarbon or halogenated hydrocarbon.

After contact of the two liquids is effected, the respective phases are separated from one another. Preferably, the contact of the two liquids occurs under conditions sufficient to provide transfer of a significant amount of the desired tobacco substance(s) from the extraction solvent to the second solvent. Additionally, it is preferable that agitation of the phases during contact thereof be such that emulsion formation is minimized or eliminated. Typically, when a Karr Reciprocating Plate Extraction Column is employed to perform the liquid/liquid extraction process, the lighter phase (e.g., most often the extraction solvent carrying tobacco extract components which remain after contact with the second solvent) preferably exits the upper output region of the column and is collected; and the heavier phase (e.g., most often the denser second solvent carrying selected tobacco substance(s) removed from the extraction solvent) preferably exits the lower output region of the column and is collected. Other apparatus for contacting and/or separating the two solvents and tobacco components extracted thereby (e.g., separation funnels, centrifugal extractors and rotating disc columns) will be apparent to the skilled artisan.

The selected tobacco substance(s) which are carried by the second solvent after the liquid/liquid extraction process normally are separated from the second solvent (i.e., are isolated). Typically, the second solvent is subjected to distillation conditions, and the tobacco components contained therein are collected. Alternatively, when the second solvent has been used to extract nicotine from an aqueous tobacco extract, the second solvent can be subjected to a liquid/liquid extraction process with an acidified aqueous solution to remove the nicotine from the second solvent. The second solvent so treated, essentially absent of tobacco substances, then can be re-employed for further liquid/liquid extraction processing steps.

The tobacco extract which remains within the extraction solvent after the liquid/liquid extraction process can be employed as is, concentrated and employed, diluted with extraction solvent and employed, or separated from the extraction solvent (i.e., isolated). For example, the aqueous extract which is collected after the liquid/liquid extraction process can be freeze dried, spray dried, or the like, so that a great majority of the extraction solvent is removed therefrom. As such, concentrated, processed tobacco extracts in stabilized form can be provided. The concentrated, processed tobacco extract then can be provided within extraction solvent for further use according to the process of the present invention.

An aqueous tobacco extract having a relatively high level of added ammonia, and which has been denicotinized using a liquid/liquid extraction process, can have essentially all or part of the added ammonia removed therefrom. For example, the denicotinized aqueous tobacco extract can be subjected to distillation conditions (i.e., under conditions to evaporate ammonia) or spray dried (i.e., so as to evaporate ammonia and water, and hence provide a powdered, spray dried, denicotinized tobacco extract). Distillation and spray drying techniques can vary, and will be apparent to the skilled artisan. Although less preferred, a denicotinized aqueous tobacco extract having a relatively high pH (i.e., due to added ammonia) can be neutralized by contacting the aqueous extract with an effective amount of an acidic substance.

A particularly preferred process for removing ammonia from a denicotinized aqueous tobacco extract involves vacuum distillation of the aqueous extract using a distillation column. Representative distillation columns are described by McCabe and Smith in *Unit Operations of Chemical Engineering*, Chapter 12, (1956). For example, a denicotinized aqueous tobacco extract having a dissolved tobacco solids content of about 10 to about 15 weight percent is introduced into the tenth stage of a distillation column having 15 theoretical stages, and maintained at a pressure of about 300 mm Hg absolute and a temperature of about 80° C. As such, an "overhead distillate" of ammonia and water is removed from the top of the column, and denicotinized aqueous tobacco extract having dissolved tobacco solids content of about 15 to about 25 weight percent and a pH of about 7 is removed from the column as a "bottoms product."

The processed tobacco extract is provided within extraction solvent. As such, a further amount of extraction solvent can be added to the processed tobacco extract, or the processed tobacco extract within extraction solvent can be concentrated. Normally, a predetermined amount of processed tobacco extract (i.e., dissolved tobacco solids) is provided within extraction solvent. The predetermined amount of tobacco extract is such that, when the contact of tobacco material with the tobacco extract and solvent is complete, and a portion of the solvent and tobacco extract is separated therefrom, a predetermined portion of the solvent and tobacco extract remains in contact with the insoluble tobacco portion of the tobacco material.

An aqueous denicotinized tobacco extract (i.e., a processed extract within extraction solvent) normally is provided such that the dissolved tobacco solids within the solvent is between about 10 and about 30 percent, preferably between about 15 and about 25 percent, more preferably between about 17 and about 20 percent, based on the total weight of the tobacco extract and solvent. Such an aqueous extract can be contacted with tobacco material, and the insoluble portion of the tobacco material can be deliquored to provide a moist mixture of insoluble tobacco material and tobacco extract having a moisture content of about 50 to about 95 weight percent, preferably about 60 to about 90 weight percent. For example, an aqueous denicotinized tobacco extract having a dissolved tobacco solids content of about 18 weight percent can be contacted with tobacco material, and the insoluble tobacco material is deliquored to a moisture level of about 70 weight percent in order to provide, upon drying (i.e., after removal of moisture), a denicotinized tobacco material having desirable levels of both water insoluble and water soluble tobacco components.

The processed tobacco extract and extraction solvent are contacted with the tobacco material under extraction conditions. As such, certain components within the tobacco material can be extracted by the extraction solvent. Normally, extracted components include those substances which are soluble or otherwise dissolve in the solvent, or are highly dispersible within the solvent. During extraction conditions, there exists a dynamic state whereby tobacco components move (i) from the tobacco material to the solvent, and (ii) from the solvent to the tobacco material. Typically, extraction is performed within a temperature range of about 5° C. to about 75° C., with about 10° C. to about 60° C. being preferred, about 15° C. to about 35° C. being more preferred, and ambient temperature being particularly preferred. Extraction conditions are maintained until the desired amount of chemical alteration of the tobacco material occurs (e.g., certain substance(s) are removed from the tobacco material to the desired degree).

Tobacco material can be extracted in a batch-wise manner one or more times using a processed tobacco extract and solvent. Normally, the weight of extract and solvent relative to the weight of tobacco material for each batch extraction ranges from about 15:1 to about 40:1, preferably from about 20:1 to about 25:1. The number of times that the tobacco material is contacted batch-wise with the processed tobacco extract and solvent ranges from about 1 to about 8 times, preferably about 3 to about 5 times. For example, tobacco material in cut filler form can be contacted batch-wise at ambient temperature (i.e., about 22° C.) with three successive portions of a denicotinized aqueous tobacco extract having a dissolved solids content of about 10 weight percent, and the resulting slurry is subjected to a deliquoring step to provide a moist mixture of insoluble tobacco material and tobacco extract of about 78 weight percent after contact of each successive portion is complete; and after the third deliquoring step, the moist mixture of extract and insoluble tobacco material can be dried to a moisture level of about 10 to about 15 weight percent so as to provide a tobacco cut filler having undergone a nicotine reduction of about 96 weight percent.

Tobacco material can be extracted continuously using a processed tobacco extract and solvent. Normally, the weight of extract and solvent contacted with the tobacco material during a continuous extraction process is greater than about 40:1, preferably greater than about 50:1.

The tobacco material which has been contacted with the processed tobacco extract and extraction solvent is separated from a portion of the tobacco extract and solvent (e.g., the mixture is deliquored). As such, there is provided a mixture of extraction solvent, extract and tobacco material insoluble in the solvent (e.g., a moist mixture of extract and water insoluble tobacco material, when the solvent is water). The tobacco material insoluble in the solvent can vary, depending upon the solvent and extraction conditions. However, for a solvent having an aqueous character, a typical insoluble tobacco material includes cellulosics and other tobacco materials which are not dissolved in the solvent or are not otherwise extracted. For purposes of the present invention, insoluble materials are tobacco components not extracted by the particular solvent which is employed under the extraction conditions which are employed.

Typical deliquoring processes or steps involve using presses, converging belts, centrifuges, screw presses, rotating disk presses, or the like. The deliquored tobacco material can be dried using hot air columns, apron dryers, or the like. Typically, deliquored tobacco material is dried to a moisture level of about 10 to about 15 weight percent, preferably about 12 to about 13 weight percent.

Tobacco extract and extraction solvent which were contacted with the tobacco material (i.e., the extract and solvent separated from the tobacco material, including the portion separated during the deliquoring step) are collected and processed. For example, the extract so collected can be processed to remove certain substance(s) therefrom, have certain additives applied thereto, and/or provided at a desired dissolved solids level with extraction solvent. As such, a processed extract is regenerated for use in altering the chemical composition of a further lot of tobacco material.

The following examples are provided in order to further illustrate various embodiments of the invention, but should not be construed as limiting the scope thereof. Unless otherwise noted, all parts and percentages are by weight.

EXAMPLE 1

A process for selectively removing nicotine from tobacco is performed as follows:

Aged flue-cured tobacco in cut filler form and having a dry weight nicotine content of about 2.5 percent is divided into lots or portions. One lot is retained for later use. The other lot is extracted in a stainless steel tank at a concentration of about 120 kg of tobacco per cubic meter of tap water. The extraction is conducted at ambient temperature (e.g., about 20° C.) while mechanically agitating the mixture over about a 1 hour period. The admixture (i.e., an aqueous tobacco extract and an insoluble portion) is centrifuged to remove as much aqueous extract as possible from the insoluble portion. The aqueous extract is concentrated in a thin film evaporator to a concentration of about 30 percent dissolved solids. Thin film evaporation conditions are such that water is evaporated from the extract while loss of tobacco volatiles is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried tobacco extract is a brown, powdery material, and has a moisture content of about 5 to about 6 percent, and a nicotine content of about 5 percent. Spray drying allows the tobacco extract to be stored for further use.

The spray dried extract then is contacted with tap water at ambient temperature in the amount of about 18 parts extract to about 82 parts tap water. The resulting aqueous tobacco extract, which exhibits a pH of about 5, is filtered to remove suspended particulate matter therefrom. To the solution is added a sufficient amount of a solution of aqueous ammonium hydroxide to provide an aqueous tobacco extract exhibiting a pH of about 10. The nicotine content of the aqueous tobacco extract so provided is about 0.7 percent.

A Karr Reciprocating Plate Extraction Column as shown generally in FIG. 2 is provided. The column is a Model KC-1-8-XE-SS from Chem-Pro Corp., Fairfield, N.J. The column includes a glass tube having a length of about 2.44 m and an inner diameter of about 2.54 cm. Through the column extends a shaft having a diameter of about 6 mm. On the shaft is positioned about 48 generally circular extraction plates at about 5 cm intervals. The plates are manufactured from stainless steel, have a thickness of about 1.6 mm, have a diameter of slightly less than 5 cm, and have the shape and configuration shown generally in FIG. 3. The movement of the shaft is controlled at a reciprocation of about 200 strokes per minute and a reciprocation amplitude of 4.45 cm by a variable speed drive agitator positioned above the column.

Into the lower input region of the column is fed the aqueous tobacco extract at a rate of about 2.5 kg per hour. Into the upper input region of the column is fed Freon 11 at a rate of about 17 kg per hour. Feed of each of the aqueous tobacco extract and the Freon 11 is provided by air driven gear pumps. The Freon 11 and the aqueous tobacco extract each are chilled to about 12° C. prior to introduction into the column, in order to prevent the Freon 11 from boiling. In addition, a water cooled coil which surrounds the column maintains the column at a temperature of about 14° C. The aqueous tobacco extract and the Freon 11 are subjected to a countercurrent extraction process.

The aqueous tobacco extract is removed from the column at the upper output region, and collected in a stainless steel reservoir. The Freon 11 is removed from the column at the lower output region, and is collected in a stainless steel reservoir.

The nicotine content of the aqueous tobacco extract so collected is about 0.01 percent. By difference, the nicotine extraction efficiency is above 98 percent. The aqueous tobacco extract then is spray dried in a manner similar to the previously described spray drying process. As such, a substantial quantity of water and essentially all of the ammonia provided as the added ammonium hydroxide is separated from the denicotinized tobacco extract.

The Freon 11 and tobacco components therein are subjected to mild distillation conditions at about 30° C., and the Freon 11 distillate is collected. A brown liquid of high viscosity and containing over 60 percent nicotine is isolated.

Another lot (i.e., the retained portion) of the flue-cured tobacco cut filler is placed into the container shown generally in FIG. 4. The container has the shape of a cylinder having a closed bottom and a top which is open to the atmosphere. The container is 28 cm high and 25.5 cm in diameter. An extract/solvent inlet port is positioned along the peripheral face of the container near the bottom of the container, and an extract/solvent exit port is positioned along the peripheral face of the container about 5 cm from the top of the container. A mesh wire screen having a 2.5 mm particle retention is positioned just below the exit port. A small tube having pinhole perforations is positioned along the bottom of the container just below the inlet port. The tube is attached to a laboratory air line.

The previously described denicotinized spray dried extract is contacted with tap water such that the denicotinized tobacco extract dissolved solids content within the solvent is about 18 percent, based on the total weight of the extract and solvent. About 10 1 of the resulting aqueous tobacco extract is provided at ambient temperature and is introduced into the container containing about 500 g of the cut filler. Then, a further amount of the aqueous tobacco extract is provided at ambient temperature and is introduced into the container at a 500 ml/min. rate, for about a 40 minute period. The aqueous tobacco extract is introduced into the container using a peristaltic pump. As such, about 60 parts aqueous tobacco extract are contacted under ambient conditions with about 1 part cut filler. During contact of the aqueous tobacco extract and cut filler, air is bubbled into the mixture to effect good turbulence (e.g., and hence mixing) of the mixture, while minimizing degradation of the tobacco cut filler. Air is bubbled through the mixture at such a rate that the mixture appears to be simmering.

The processed insoluble tobacco material is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 15.5 percent, and an insoluble tobacco material content of about 14.5 percent. The deliquored cut filler (e.g., a moist cake) is passed twice through a hot air column set at about 150° C. to dry the cut filler to a moisture level of about 28 percent. The cut filler then is air dried to a moisture level of about 13 percent.

The tobacco filler so provided has a nicotine content of about 0.15 percent, on a dry weight basis. The tobacco filler so processed is used as cut filler in cigarette manufacture.

The aqueous tobacco extract collected after contact with the cut filler is subjected to denicotinization process steps as described previously, and employed to process yet a further portion or lot of flue-cured tobacco cut filler.

EXAMPLE 2

A process for selectively removing nicotine from tobacco is performed as follows:

Aged flue-cured tobacco in cut filler form and having a dry weight nicotine content of about 2.5 percent is divided into lots or portions. One lot is retained for later use. The other lot is extracted and spray dried as described in Example 1. The spray dried tobacco extract is a brown, powdery material, and has a moisture content of about 5 to about 6 percent, and a nicotine content of about 5 percent.

The spray dried extract then is contacted with warm tap water in the amount of about 15 parts extract to about 85 parts tap water. The resulting aqueous tobacco extract, which exhibits a pH of about 5, is filtered to remove suspended particulate matter therefrom. To the solution is added a sufficient amount of a solution of aqueous ammonium hydroxide to provide an aqueous tobacco extract exhibiting a pH of about 10. The nicotine content of the aqueous tobacco extract so provided is about 0.6 percent.

A Karr Reciprocating Plate Extraction Column as described in Example 1 is provided. The movement of the shaft which extends through the column is controlled at a reciprocation of about 200 strokes per minute and a reciprocation amplitude of 4.45 cm by a variable speed drive agitator positioned above the column.

Into the lower input region of the column is fed the aqueous tobacco extract at a rate of about 4.5 kg per hour. Into the upper input region of the column is fed Freon 11 at a rate of about 11.5 kg per hour. Feed of each of the aqueous tobacco extract and the Freon 11 is provided by air driven gear pumps. The Freon 11 and the aqueous tobacco extract each are chilled to about 12° C. prior to introduction into the column, in order to prevent the Freon 11 from boiling. In addition, a water cooled coil which surrounds the column maintains the column at a temperature of about 14° C. The aqueous tobacco extract and the Freon 11 are subjected to a countercurrent extraction process.

The aqueous tobacco extract is removed from the column at the upper output region, and collected in a stainless steel reservoir. The Freon 11 is removed from the column at the lower output region, and is collected in a stainless steel reservoir.

The nicotine content of the aqueous tobacco extract so collected is about 0.01 percent. By difference, the nicotine extraction efficiency is above 98 percent. The aqueous tobacco extract then is spray dried in a manner similar to the previously described spray drying process. As such, a substantial quantity of water and essentially all of the ammonia provided as the added ammonium hydroxide is separated from the denicotinized tobacco extract.

The Freon 11 and tobacco components therein are subjected to mild distillation conditions at about 30° C., and the Freon 11 distillate is collected. A brown liquid of high viscosity and containing over 60 percent nicotine is isolated.

Another lot (i.e., the retained portion) of the flue-cured tobacco cut filler is placed into the container described in Example 1.

The previously described denicotinized spray dried extract is contacted with tap water such that the denicotinized tobacco extract dissolved solids content within the solvent is about 18.5 percent, based on the total weight of the extract and solvent. About 10 1 of the resulting aqueous tobacco extract is provided at ambient temperature and is introduced into the container containing about 800 g of the cut filler. Then, a further amount of the aqueous tobacco extract is provided at ambient temperature and is introduced into the container at a 500 ml/min. rate, for about a 2.5 hour period. The aqueous tobacco extract is introduced into the container using a peristaltic pump. As such, about 106 parts aqueous tobacco extract are contacted under ambient conditions with about 1 part cut filler. During contact of the aqueous tobacco extract and cut filler, air is bubbled into the mixture to effect good turbulence (e.g., and hence mixing) of the mixture, while minimizing degradation of the tobacco cut filler. Air is bubbled through the mixture at such a rate that the mixture appears to be simmering.

The processed insoluble tobacco material is removed from the container, and a portion of the aqueous tobacco extract which is in contact with the insoluble tobacco material is removed therefrom using a batch hydraulic press. As such, there is provided a damp, processed, deliquored cut filler having a moisture content of about 70 percent, a tobacco extract content of about 15.5 percent, and an insoluble tobacco material content of about 14.5 percent. The deliquored cut filler (e.g., a moist cake) is passed twice through a hot air column set at about 150° C. to dry the cut filler to a moisture level of about 28 percent. The cut filler then is air dried to a moisture level of about 13 percent.

The tobacco filler so provided has a nicotine content of about 0.08 percent, on a dry weight basis. The tobacco filler so processed is used as cut filler in cigarette manufacture.

The aqueous tobacco extract collected after contact with the cut filler is subjected to denicotinization process steps as described previously, and employed to process yet a further portion or lot of flue-cured tobacco cut filler.

What is claimed is:

1. A process for removing at least one selected substance from tobacco material to provide a processed tobacco material, the process comprising:

(a) extracting tobacco material with extraction solvent to provide a tobacco extract within the extraction solvent;

(b) removing at least one selected substance from the tobacco extract to provide a processed tobacco extract;

(c) providing the processed tobacco extract within extraction solvent in an amount which ranges from about 10 to about 30 percent, based on the total weight of the extract and solvent;

(d) contacting the processed tobacco extract within extraction solvent with a further amount of tobacco material under extraction conditions, thereby providing a mixture of solvent, tobacco extract and tobacco material insoluble in the solvent;

(e) separating the tobacco material insoluble in the solvent from a portion of the solvent and tobacco extract; thereby providing a mixture of solvent, tobacco extract and tobacco material insoluble in the solvent in which a predetermined portion of the solvent and tobacco extract remains in contact with the tobacco material insoluble in the solvent; and (f) separating at least a portion of the solvent from the mixture provided in step (e) to provide a processed tobacco material.

2. The process of claim 1 further comprising:

(g) removing at least one selected substance from the portion of solvent and tobacco extract separated from the mixture of solvent, tobacco extract and tobacco material insoluble in the solvent according to step (e) to provide a further processed tobacco extract;

(h) contacting the further processed tobacco extract within extraction solvent with yet a further amount of tobacco material under extraction conditions, thereby providing a mixture of solvent, tobacco extract and tobacco material insoluble in the solvent;

(i) separating the tobacco material insoluble in the solvent from a portion of the solvent and tobacco extract; thereby providing a mixture of solvent, tobacco extract and tobacco material insoluble in the solvent in which a predetermined portion of the solvent and tobacco extract remains in contact with the tobacco material insoluble in the solvent; and (j) separating at least a portion of the solvent from the mixture provided in step (i) to provide a processed tobacco material.

3. The process of claim 1 or 2 whereby the amount of processed tobacco extract within extraction solvent ranges from about 15 to about 25 percent, based on the total weight of the extract and solvent.

4. The process of claim 1 or 2 whereby the extraction solvent is a liquid having an aqueous character.

5. The process of claim 4 whereby the selected substance includes nicotine.

6. The process of claim 4 whereby the liquid having an aqueous character is greater than 90 weight percent water.

7. The process of claim 1 or 2 whereby the extraction solvent is essentially pure water.

8. The process of claim 1 or 2 whereby the selected substance includes nicotine.

9. The process of claim 1 or 2 whereby the tobacco material includes flue-cured tobacco in cut filler form.

10. The process of claim 2 whereby in steps (e) and (g), the further amount of tobacco material is continuously contacted with the processed tobacco extract within extraction solvent.

11. The process of claim 1 or 2 whereby 1 weight part of the further amount of tobacco material is contacted, under extraction conditions, with at least about 40 weight parts of the processed tobacco extract and extraction solvent.

12. The process of claim 1 or 2 whereby the solvent content of the mixture provided in step (e) ranges from about 60 to about 90 percent, based on the total weight of the solvent, tobacco extract and tobacco material insoluble in the solvent.

13. The process of claim 1 whereby the solvent is essentially pure water, and sufficient solvent is separated from the mixture provided in step (e) to provide a mixture of tobacco extract and tobacco material insoluble in the solvent having a moisture level between about 10 and about 15 weight percent.

14. The process of claim 1 whereby steps (a) and (d) each are performed at approximately the same temperature.

15. The process of claim 1 whereby steps (a) and (d) each are performed at ambient temperature.

16. The process of claim 1 or 2 whereby the extraction solvent is a solvent having an aqueous character, and whereby the solvent content of the mixture provided in step (e) ranges from about 60 to about 90 percent, based on the total weight of the solvent, tobacco extract and tobacco material insoluble in the solvent.

17. The process of claim 1 whereby the type of tobacco material extracted in step (a) is the same type of tobacco material which is employed in step (d).

18. The process of claim 1 whereby the extraction solvent is a liquid having an aqueous character, and nicotine is removed from the tobacco extract to provide a processed extract by:

(i) providing a tobacco extract/extraction solvent mixture having a pH of about 9 or more, (ii) contacting the tobacco extract/extraction solvent mixture with a second liquid immiscible with the extraction solvent and having a preferential solubility for nicotine under conditions such that there is provided a denicotinized tobacco extract/extraction solvent mixture and a second liquid containing nicotine, and (iii) separating the denicotinized tobacco extract/extraction solvent mixture from the second solvent containing nicotine.

19. The process of claim 18 whereby the second liquid is a halogenated hydrocarbon.

20. The process of claim 18 whereby the liquid having an aqueous character is greater than 90 weight percent water.

21. The process of claim 1 whereby in step (e), the further amount of tobacco material is continuously contacted with the processed tobacco extract within extraction solvent.

22. The process of claim 1 whereby (i) 1 weight part of the further amount of tobacco material is contacted, under extraction conditions, with at least about 40 weight parts of the processed tobacco extract and extraction solvent; and (ii) in step (e), the further amount of tobacco material is continuously contacted with the processed tobacco extract within extraction solvent.

23. The process of claim 22 whereby the extraction solvent is a liquid having an aqueous character.

24. The process of claim 22 or 23 whereby the solvent content of the mixture provided in step (e) ranges from about 60 to about 90 percent, based on the total weight of the solvent, tobacco extract and tobacco material insoluble in the solvent.

25. The process of claim 22 or 23 whereby the selected substance includes nicotine.

26. A process for altering the chemical composition of a tobacco material to provide a processed tobacco material, the process comprising:

(a) extracting tobacco material with extraction solvent to provide a tobacco extract within the extraction solvent;

(b) altering the chemical composition of the tobacco extract to provide a processed tobacco extract;

(c) providing the processed tobacco extract within extraction solvent in an amount which ranges from about 10 to about 30 percent, based on the total weight of the extract and solvent;

(d) contacting the processed tobacco extract within extraction solvent with a further amount of tobacco material under extraction conditions, thereby providing a mixture of solvent, tobacco extract and tobacco material insoluble in the solvent;

(e) separating the tobacco material insoluble in the solvent from a portion of the solvent and tobacco extract; thereby providing a mixture of solvent, tobacco extract and tobacco material insoluble in the solvent in which a predetermined portion of the solvent and tobacco extract remains in contact with the tobacco material insoluble in the solvent; and (f) separating at least a portion of the solvent from the mixture provided in step (e) to provide a processed tobacco material.

27. The process of claim 26 whereby at least one additive is incorporated into the extract in step (b).

28. The process of claim 27 whereby the extraction solvent is a liquid having an aqueous character.

29. The process of claim 28 whereby the liquid having an aqueous character is greater than 90 weight percent water.

30. The process of claim 27 whereby the extraction solvent is a liquid having an aqueous character, and at least one selected substance is removed from the extract in step (b).

31. The process of claim 27 whereby at least one selected substance is removed from the extract in step (b).

32. The process of claim 26 whereby the extraction solvent is a liquid having an aqueous character.

33. The process of claim 32 whereby the liquid having an aqueous character is greater than 90 weight percent water.

34. The process of claim 26 whereby 1 weight part of the further amount of tobacco material is contacted, under extraction conditions, with at least about 40 weight parts of the processed tobacco extract and extraction solvent.

35. The process of claim 26 whereby the solvent content of the mixture provided in step (e) ranges from about 60 to about 90 percent, based on the total weight of the solvent, tobacco extract and tobacco material insoluble in the solvent.

36. The process of claim 26 whereby steps (a) and (d) each are performed at ambient temperature.

37. The process of claim 26 further comprising:

(g) altering the chemical composition of the portion of the extract separated from the mixture of solvent, tobacco extract and tobacco material in the solvent according to step (e) to provide a further processed tobacco extract;

(h) contacting the further processed tobacco extract within extraction solvent with yet a further amount of tobacco material under extraction conditions, thereby providing a mixture of solvent, tobacco extract and tobacco material insoluble in the solvent; and (i) separating the tobacco material insoluble in the solvent from a portion of the solvent and tobacco extract; thereby providing a mixture of solvent, tobacco extract and tobacco material insoluble in the solvent in which a predetermined portion of the solvent and tobacco extract remains in contact with the tobacco material insoluble in the solvent; and (j) separating at least a portion of the solvent from the mixture provided in step (i) to provide a processed tobacco material.

38. The process of claim 26, 27 or 31 whereby in step (e), the further amount of tobacco material is continuously contacted with the processed tobacco extract within extraction solvent.

39. The process of claim 37 whereby in steps (e) and (g), the further amount of tobacco material is continuously contacted with the processed tobacco extract within extraction solvent.

* * * * *

UNITED STATES PATENT AND TRADEMARK OFFICE

CERTIFICATE OF CORRECTION

PATENT NO. : 5,025,812

DATED : June 25, 1991

INVENTOR(S) : Barry S. Fagg et al.

It is certified that error appears in the above—identified patent and that said Letters Patent is hereby corrected as shown below:

Please add the following U.S. Patent Documents as references cited on the title page of the above-identified Letters Patent:

--U.S. PATENT DOCUMENTS

| | | |
|---|---|---|
| 2,770,239 | 11/1956 | Prats et al. |
| 4,962,774 | 10/1990 | Thomasson et al.-- |

Signed and Sealed this

Twenty-ninth Day of December, 1992

*Attest:*

DOUGLAS B. COMER

*Attesting Officer*

*Acting Commissioner of Patents and Trademarks*